US006675813B2

(12) United States Patent
Chu

(10) Patent No.: US 6,675,813 B2
(45) Date of Patent: Jan. 13, 2004

(54) NAIL APPARATUS AND METHOD

(76) Inventor: Tot T. Chu, 717 Sunny Pine Way #A1, West Palm Beach, FL (US) 33415

( * ) Notice: Subject to any disclaimer, the term of this patent is extended or adjusted under 35 U.S.C. 154(b) by 44 days.

(21) Appl. No.: 10/008,584

(22) Filed: Nov. 13, 2001

(65) Prior Publication Data

US 2003/0089378 A1 May 15, 2003

(51) Int. Cl.[7] ..... A45D 24/00
(52) U.S. Cl. ..... 132/200
(58) Field of Search ..... 132/200, 73.5, 132/75.3, 75.6, 76.6, 285, 73

(56) References Cited

U.S. PATENT DOCUMENTS 273,821 A * 3/1883 Crosthwaite ..... 132/73.5
606,937 A * 7/1898 Pancoast ..... 132/75.6
1,138,967 A * 5/1915 Metzger ..... 132/75.6
1,855,063 A * 4/1932 Lovette ..... 132/75.6
2,220,758 A 11/1940 Florio
D152,708 S * 2/1949 Levnaich ..... 132/73.5
2,513,208 A * 6/1950 Rogers
2,670,745 A 3/1954 Lui
4,559,957 A * 12/1985 Hokama ..... 132/73
4,765,350 A * 8/1988 Moore ..... 132/75.6
4,805,645 A 2/1989 Schiff et al.
5,645,090 A 7/1997 Juhl et al.
5,755,239 A * 5/1998 Baltierra ..... 132/73
5,924,428 A 7/1999 Song
5,927,293 A * 7/1999 Halpern ..... 132/200
D418,250 S 12/1999 Baltierra

* cited by examiner

*Primary Examiner*—John J. Wilson
*Assistant Examiner*—Robyn Kieu Doan
(74) *Attorney, Agent, or Firm*—Akerman Senterfitt

(57) ABSTRACT

The invention provides a manicure tool, including a guide head having a curved lower edge. The lower edge has a longitudinal curve and a rearward curve. In another aspect, the lower edge is concave. A method for applying a manicure material to a nail to form a border is also described.

12 Claims, 3 Drawing Sheets

NAIL APPARATUS AND METHOD

CROSS-REFERENCE TO RELATED APPLICATIONS (Not Applicable)

STATEMENT REGARDING FEDERALLY SPONSORED RESEARCH OR DEVELOPMENT (Not Applicable)

BACKGROUND

1. Technical Field

The present invention relates generally to cosmetics, and more particularly to the cosmetic enhancement of nails.

2. Description of Related Art

Currently, many individuals cosmetically enhance their fingernails or toenails by securing artificial nails to their natural nails. Many of these individuals visit nail salons where a nail technician performs such a task. As an example, the nail technician can clean the individual's natural nail and can then secure an artificial nail to the upper portion of the natural nail. Typically, the artificial nail is constructed of a durable white or transparent plastic and is secured to the natural nail with an adhesive. In addition, the end of the artificial nail that is secured to the natural nail is typically semi-circular in shape to follow the contour of the individual's natural nail. Once secured to the natural nail, the artificial nail can then be trimmed and filed according to the individual's specifications.

In certain cases, the artificial nail recipient requests a French manicure or pedicure in which the artificial nail is accentuated by the creation of a white strip that covers the surface of the artificial nail. To create such an effect, a combination of acrylic polishes can be applied to the artificial nail and the individual's natural nail. These acrylic polishes are actually acrylic powders which have been mixed with an acrylic liquid. Normally, one of the polishes is white or off-white in color, and the other is somewhat pinkish in color. The nail technician uses a brush to apply the white polish to the surface of the artificial nail. During this process, the nail technician must follow a line of demarcation, typically the semi-circular edge of the artificial nail that is attached to the natural nail, as the technician applies the white polish. This line of demarcation is commonly referred to as a "smile line." In most cases, the nail technician applies the white polish up to the boundary of the semi-circular edge of the artificial nail; however, if the artificial nail recipient has short natural nails, then the smile line may be created above the edge of the artificial nail, as applying the white polish up to the edge of the artificial nail may produce a smile line that is too low.

Once the smile line is created and the white polish hardens, the nail technician applies the pinkish polish to the surface of the natural nail and the surface of the hardened white polish now covering the surface of the artificial nail. The pinkish polish, however, does not substantially affect the color of the hardened polish covering the artificial nail but does enhance the color of the natural nail making the natural nail look healthier. Thus, the combination of polishes not only creates the French manicure or pedicure effect but also protects the natural nail and the artificial nail thereby extending the life of the artificial nail enhancement. The newly enhanced nail is then smoothed with a nail file.

This form of enhancing nails, however, suffers from several significant disadvantages. Namely, it can be very difficult to create uniform smile lines for each nail, as the nail technician must maintain a steady hand as he or she applies the white polish. This process is especially difficult if the nail technician is using transparent artificial nails, as the edge of the transparent artificial nail is difficult to discern from the natural nail. Although the use of white artificial nails may make the application of the white polish somewhat easier as the boundary between the artificial nail and the natural nail is easier to distinguish, the white artificial nails may not be useful if the artificial nail recipient has short natural nails. This is because the smile line may have to be placed above the edge of the artificial nails, as the edge may be too low to serve as the boundary for the smile line. Even if the natural nails to which the artificial nails will be attached are sufficiently long enough to permit the nail technician to apply the white paste along the edge of the artificial nail, the nail technician still must maintain a steady hand as the polish is applied to ensure a uniform smile line.

SUMMARY OF THE INVENTION

A manicure tool includes a guide head having a curved lower edge. The lower edge has a longitudinal curve and a rearward curve. The manicure tool can include a handle portion at an end of the guide head substantially opposite to the lower edge. The guide head can have a substantially arcuate cross section.

In another aspect the invention features a method for forming a border on a nail with a manicure material. This method includes the steps of: (a) providing a manicure tool comprising a guide head having a curved lower edge, the lower edge having a longitudinal curve and a rearward curve; and (b) positioning the curved lower edge against the nail and utilizing the lower edge to form a border with the manicure material.

The utilization of the lower edge can include one of several methods. In one variation, the utilization includes moving the lower edge in a scraping motion along the surface of the nail. In another variation, the utilization includes positioning the lower edge against the nail and applying the manicure material to the nail along the lower edge to form a border.

The manicure material can include one of many different compositions. In one variation, the manicure material is an acrylic. After the manicure material is applied to the nail, another coat of manicure material is applied to the nail. An artificial nail can be adhered to a natural nail and then the initial coat of manicure material can be applied. Another coat of manicure material is applied after the initial coat of manicure material has been applied.

In another aspect the invention features a manicure tool including a guide head having a concave lower edge. The lower edge is dimensioned so as to substantially mate with the surface of a nail. The lower edge facilitates the application of a manicure material to the nail.

In yet another aspect the invention features a method for forming a border on a nail with a manicure material, including the steps of: (a) providing a manicure tool, including a guide head having a curved lower edge, the lower edge being curved for substantially mating with the surface of the nail; and (b) positioning the lower edge against the nail and utilizing the lower edge to form a border with the manicure material. The lower edge can be used to apply the manicure material to a nail in a manner forming a straight border, or in other border shapes.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF THE PREFERRED EMBODIMENTS

Figure 1:
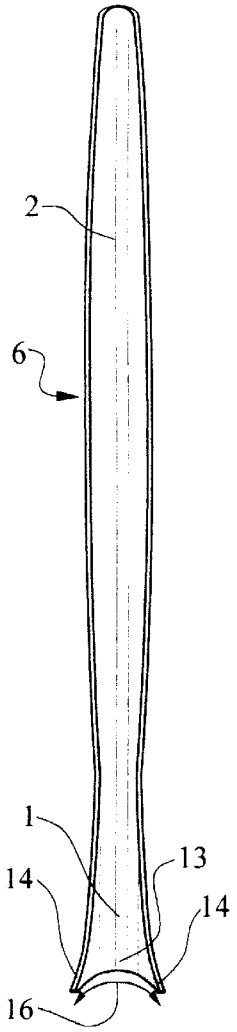
FIG. 1 is a rear view of the manicure tool.
Figure 2:
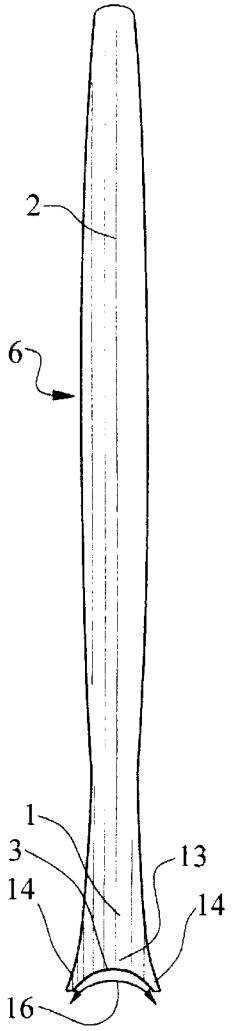
FIG. 2 is a front view of the manicure tool.
Figure 3:
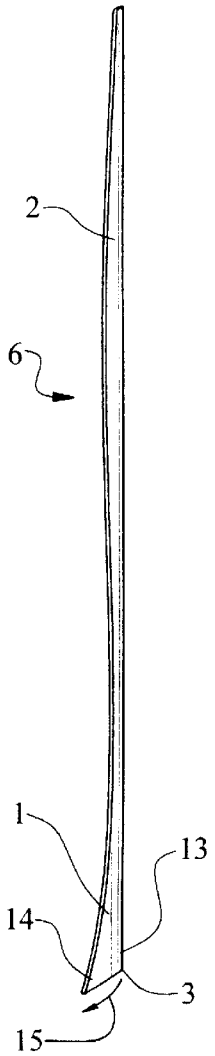
FIG. 3 is a side view of the manicure tool.

A manicure tool according to the invention includes a guide head with a concave lower edge. The lower edge is used to apply a manicure material to a nail. FIGS. 1–3 illustrate a manicure tool 6, according to the preferred embodiment of the invention, which can be used during the application of a manicure material to form a border. The manicure tool 6 can include a guide head 1. A handle 2 can be provided at an end of the guide head 1 substantially opposite a lower edge 3. The guide head 1 can have a lower edge 3 that is curved.

Figure 5:
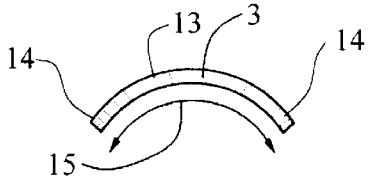
FIG. 5 is an enlarged end view of the manicure tool.

FIG. 5 illustrates an enlarged end view of the manicure tool 6. The lower edge 3 is curved to facilitate the application of a manicure material to a nail. An edge that has a rearward curve 15 when in use will permit the application of the manicure material with a curved border. The rearward curve 15 can be provided by the lower edge 3 curving rearwardly from a center 13 to the sides 14. An edge that has a longitudinal curve 16 when the manicure tool 6 is in use will permit the tool 6 to substantially mate with the surface of the nail. The guide head 1 can have a lower edge 3 that has both a rearward curve, indicated by arrow 15, and a longitudinal curve, indicated by arrow 16. A lower edge 3 that has both a rearward curve 15 and a longitudinal curve 16 will permit the application of a smoothly curved border to the surface of a nail.

Figure 4:
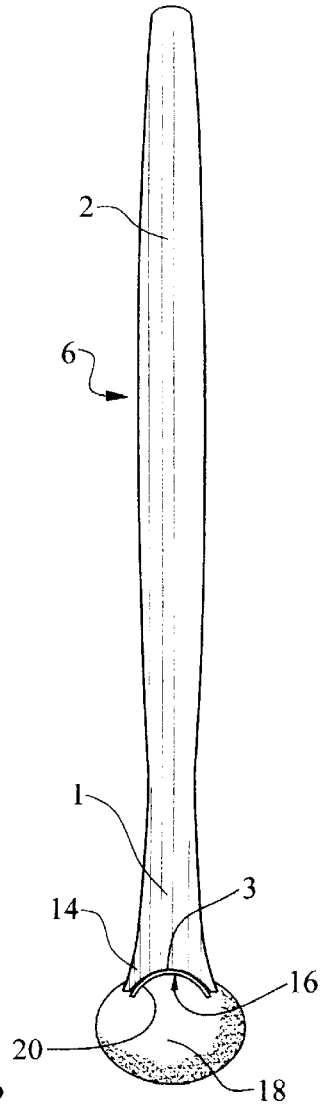
FIG. 4 is a front view of the manicure tool as positioned on a finger.

FIG. 4 illustrates the manicure tool 6 as positioned on a finger 18 onto which an artificial nail has been adhered. In the preferred embodiment, the lower edge 3 according to the invention has both the longitudinal curve 16 and the rearward curve 15. The rearward curve 15 of the lower edge 3 enables the formation of a smooth border on the surface of the artificial nail 25. The longitudinal curve 16 of the lower edge 3 has a shape that is essentially the complement of the top surface of the nail. The shape of the longitudinal curve 16 is such that when the manicure tool 6 is positioned on the finger 18, the lower edge 3 mates substantially flushly with the top surface of the artificial nail 25. Given the curved nature of the artificial nail 25, the longitudinal curve 16 is generally preferred for the lower edge 3. The rearward curve 15 permits the creation of a rearwardly curved border or smile line.

The guide head 1 and lower edge 3 can be constructed in different sizes and shapes. Different sizes can be used for different size nails. Different shapes can be used for differently shaped nails, such as for a manicure or a pedicure. The guide head 1 can have a substantially arcuate cross section, a planar cross section, or other cross section. The lower edge 3 can be formed from a portion of the guide head 1, or can extend substantially the length of the guide head 1.

The handle 2 can have any suitable configuration, and preferably is contoured to have a generally ergonomic shape which will allow the user to easily grasp and manipulate the manicure tool 6. The handle 2 can have any suitable dimensions.

The manicure tool 6 can be constructed of any suitable material, or combination of materials. In the preferred embodiment, the manicure tool 6 is constructed of a non-corrosive material, or combination of materials, that is resistant to water, detergent, manicure materials and sterilization solutions.

A method according to the invention can be used with artificial nails and all-natural nails. The method according to the invention can be used with different manicure materials. The manicure tool 6 may be used to apply any manicure material, including other colors and other materials than those of a French manicure. The manicure material can be any suitable composition or compound, such as acrylic.

Figure 6:
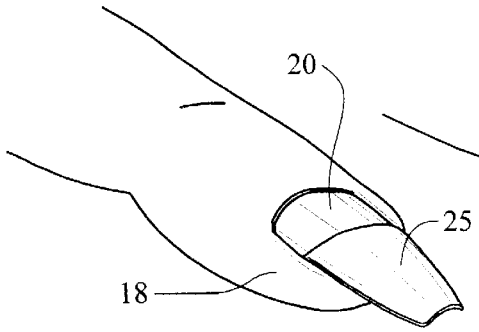
FIG. 6 is a perspective view of a first step of a method according to the invention.

The invention can be used with different manicure techniques that are known in the art for applying a manicure material to a nail. FIG. 6 illustrates a first step of a method according to the invention. The artificial nail 25 is adhered to a natural nail 20 of the finger 18. Typically, the artificial nail 25 is constructed of a durable white or transparent plastic and is secured to the natural nail 20 with a suitable adhesive.

Figure 7:
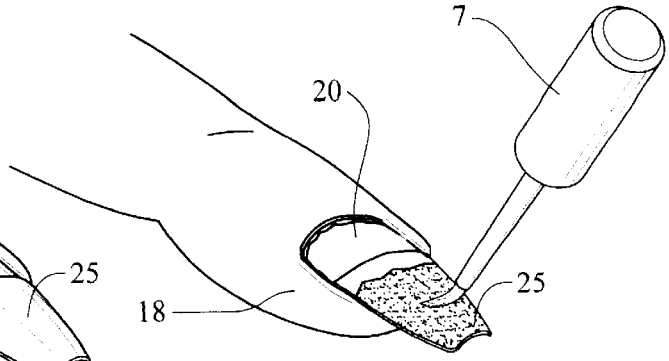
FIG. 7 is a perspective view of a second step of a method according to the invention.
Figure 8:
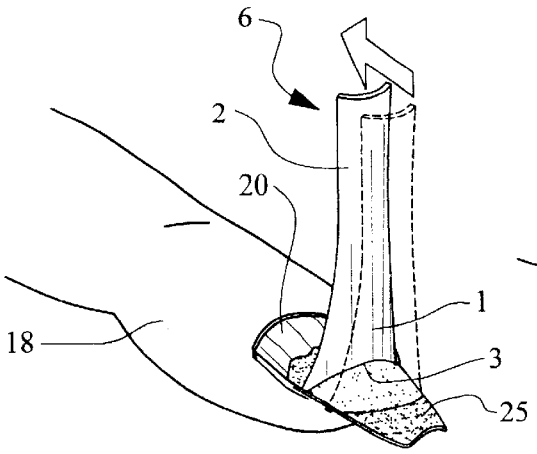
FIG. 8 is a perspective view of a third step of a method according to the invention.

The manicure tool 6 is employed by a nail technician to define a border on the artificial nail 25. As depicted in FIG. 7, a nail technician employs a brush 7 or other suitable apparatus to apply a manicure material to the artificial nail 25. As shown in FIG. 8, the manicure tool 6 is positioned with the lower edge 3 against the artificial nail 25. The lower edge 3 can be utilized to form a border with the manicure material on the surface of the nail 25. The manicure tool 6 can be manipulated so as to move the lower edge 3 in a scraping motion. The scraping motion of the lower edge 3 results in the removal of a portion of the manicure material and the formation of a smooth border commonly referred to as a "smile line." The manicure material can then be allowed to harden.

Figure 9:
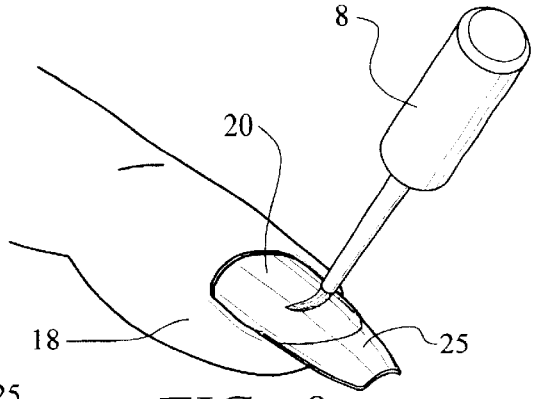
FIG. 9 is a perspective view of a fourth step of a method according to the invention.

As shown in FIG. 9, the nail technician can then employ a brush 8 to apply a second manicure material to the surface of the natural nail 20. The second manicure material can be applied to both the natural nail 20 and to the surface of the hardened first manicure material on the surface of the artificial nail 25. In a method of forming French manicured nails, the first manicure material is a white polish, and the second manicure material is a pink polish. The white polish is visible through the pink polish to create the French manicure effect.

The French manicure effect is sometimes created on all-natural nails. The term "nails" is used herein generally to refer to both natural and artificial nails, except where specified. The invention also includes a method for creating a French manicure effect on all-natural nails. The manicure tool 6 according to the invention can be used to apply a manicure material to a natural nail that does not have an artificial nail adhered thereto.

Figure 10:
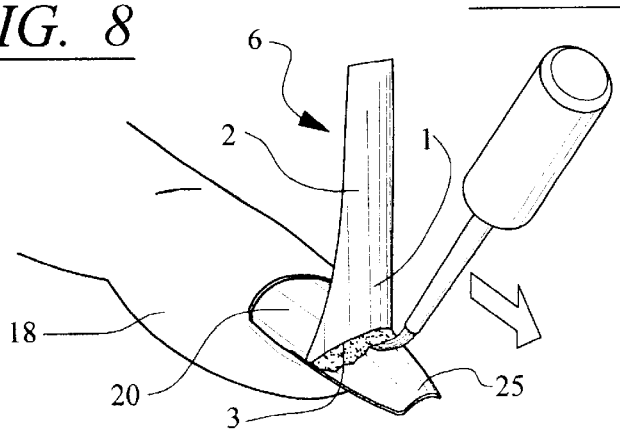
FIG. 10 is a perspective view of an alternative method according to the invention.

Other embodiments of the invention are possible. FIG. 10 illustrates an alternative method according to the invention. The manicure tool 6 is employed by a nail technician to define a border on the artificial nail 25 while the technician applies a manicure material to the surface of the artificial nail 25. As shown in FIG. 10, the manicure tool 6 is positioned with the lower edge 3 against the artificial nail 25. The manicure tool 6 can be positioned such that the guide head 1 and lower edge 3 create a curved guide edge when placed against the surface of the artificial nail 25. A nail technician employs a brush 7 or other suitable apparatus to apply a manicure material to the artificial nail 25 up to the lower edge 3, thereby creating the smooth "smile line." The manicure material can then be allowed to harden. The nail technician can then employ a second manicure material to the surface of the natural nail 20. The second manicure material can be applied to both the natural nail 20 and to the surface of the hardened first manicure material on the surface of the artificial nail 25.

Figure 11:
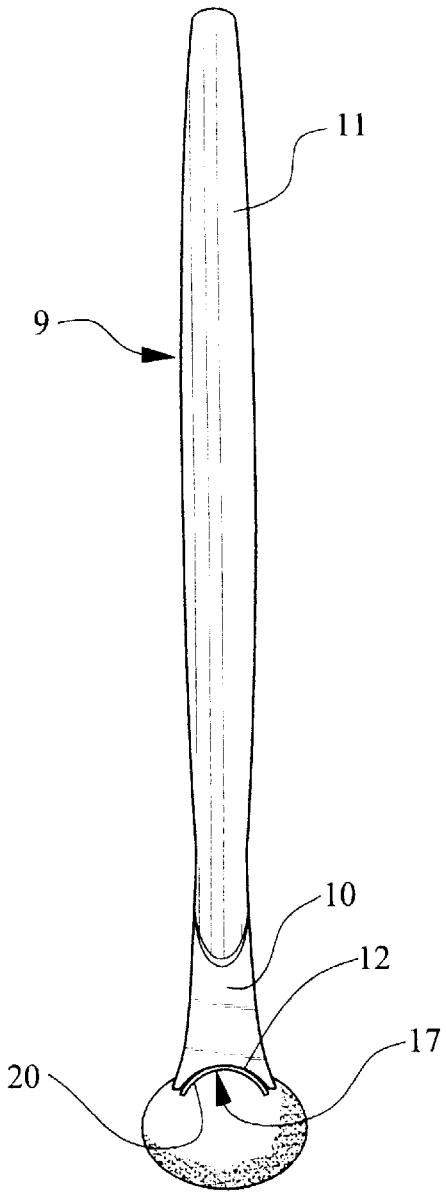
FIG. 11 is a front view of an alternative embodiment of the manicure tool positioned on a finger.
Figure 12:
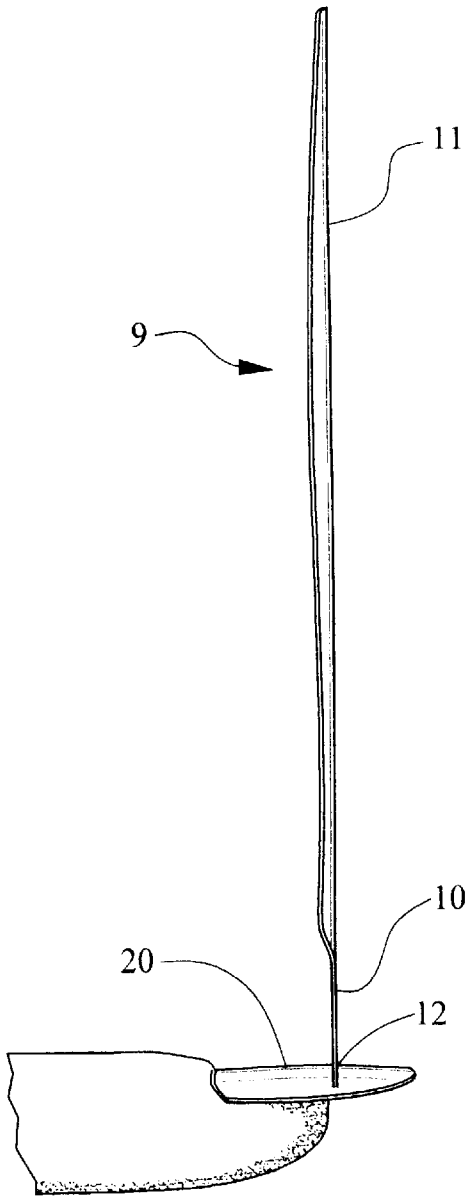
FIG. 12 is a side view of an alternative embodiment of the manicure tool positioned on a finger.

Further embodiments of the invention are possible. FIGS. 11 and 12 illustrate an alternative manicure tool 9 featuring a guide head 10 with a lower edge 12 having a longitudinal curve 17, but without a rearward curve. The guide head 10 in this embodiment can be substantially planar. The concave lower edge 12 is used to apply a manicure material to a nail 20 in a manner forming a straight border.

The manicure tool 9 is employed by a nail technician to apply a straight edge on an artificial nail or a natural nail while the technician applies a manicure material to the surface of the nail. This will permit the creation of a straight border. The manicure tool 9 is positioned with the lower edge 12 against the nail 20 and a brush is used to apply a manicure material to the surface of the artificial nail while following the straight edge created by the use of the manicure tool 9.

The guide head of the invention may be used to apply a manicure material to a nail forming a border that is neither curved nor straight. In another embodiment, the invention features a guide head having a lower edge that is used to apply a manicure material to a nail in a manner forming a variety of different artistic border designs. The guide head may be suitably shaped and used to apply a manicure material to a nail in a manner forming a corresponding border that could be a curve, a curvilinear line, a zig-zag border, or other desired border designs.

Typically a French manicure or pedicure is accentuated by the creation of a white layer of manicure material that covers the surface of the artificial nail. To create such an effect, a combination of acrylic polishes can be applied to the artificial nail and the individual's natural nail. Normally, one of the polishes is white or off-white in color, and the other is somewhat pinkish in color. The manicure tool according to the invention can be used to create the French manicure effect on a nail but other manicure methods are possible using the manicure tool according to the invention.

The invention is capable of taking a number of specific forms without departing from the spirit or essential attributes thereof. Accordingly, the following claims should be referenced to determine the scope of the invention, rather than the foregoing specification.

I claim:

1. A method for forming a border on a nail with a manicure material, comprising the steps of:

providing a manicure tool comprising a guide head having a curved lower edge, said lower edge having a longitudinal curve and a rearward curve; and positioning said curved lower edge against said nail and utilizing said lower edge to form said border with said manicure material, wherein said utilizing step comprises the step of moving said lower edge in a scraping motion to remove excess manicure material.

2. The method of claim 1, wherein said utilizing step comprises the step of positioning said lower edge against said nail and applying said manicure material to said nail along said lower edge to form a border.

3. The method of claim 1, wherein said manicure material is an acrylic.

4. The method of claim 1, wherein after said manicure material is applied to said nail, another coat of manicure material is applied to said nail.

5. The method of claim 1, wherein said manicure material is a substantially white polish, and said other coat of manicure material is a substantially pink polish.

6. The method of claim 1, wherein said nail comprises an artificial nail.

7. The method of claim 1, wherein said artificial nail is first adhered to a natural nail and then said manicure material is applied.

8. A method for forming a border on a nail with a manicure material, comprising the steps of:

providing a manicure tool comprising a guide head having a curved lower edge, said lower edge being curved for substantially mating with the surface of the nail; and positioning said lower edge against said nail and utilizing said lower edge to form said border with said manicure material, said utilizing step comprising the step of moving said lower edge in a scraping motion to remove excess manicure material.

9. The method of claim 8, wherein after said manicure material is applied to said nail, another coat of manicure material is applied to said nail.

10. The method of claim 8, wherein said manicure material is a substantially white polish, and said other coat of manicure material is a substantially pink polish.

11. The method of claim 8, wherein said nail comprises an artificial nail.

12. The method of claim 8, wherein said artificial nail is first adhered to a natural nail and then said manicure material is applied.

* * * * *